US005484456A

United States Patent [19]

Hiuke et al.

[11] Patent Number: 5,484,456

[45] Date of Patent: Jan. 16, 1996

[54] DYEING METHODS TO PRODUCE DEEP DYEINGS WITH PHTHALOCYANINE DYES

[75] Inventors: Tadashi Hiuke, Kobeshi; Yasokazu Inoue, Nishinimiyashi; Hiroshi Soga, Kobeshi, all of Japan

[73] Assignee: Sandoz Ltd., Basel, Switzerland

[21] Appl. No.: 206,476

[22] Filed: Mar. 4, 1994

[51] Int. Cl.[6] ..... C09B 62/00; D06P 3/66

[52] U.S. Cl. ..... 8/543; 8/661; 8/918; 8/921; 8/549

[58] Field of Search ..... 8/661, 918, 921, 8/543–549

[56] References Cited

U.S. PATENT DOCUMENTS 4,453,945 6/1984 Miyamoto ..... 8/543
4,711,642 12/1987 Wolff ..... 8/527

FOREIGN PATENT DOCUMENTS 112797 4/1984 European Pat. Off. .
2125443 3/1984 United Kingdom .

OTHER PUBLICATIONS

GB Search Report dated 22 Apr. 1994 for GB Appn. 9403840.3.
Search Report—Switzerland—dated 18, Nov. 1994.
Derwent Abstract of EP 112797; Apr. 1984.
M. Peter, H. K. Routette, "Grundlagen der Textilveredlung" pp. 510–512; pp. 558–559, copyright 1989, no month available.
Derwent Abstract of JP 63182479; Jan 1988.
Derwent Abstract of GB 2275693; Sep. 1994.
Color Index, 3rd edition vol. 3, p. 3506, Society of Dyers and Colorists, 1971. no month available.

*Primary Examiner*—Margaret Einsmann
*Attorney, Agent, or Firm*—Robert S. Honor; Carl W. Battle

[57] ABSTRACT

A method for deep dyeing of cellulose fibers comprising dyeing the fibers with one or more phthalocyanine reactive dyes in a liquor, containing more than 80 g/l salt at pH of 10 or more characterized in that dyeing is carried out at a temperature above 100° C. (eg about 105°– 150° C.).

13 Claims, No Drawings

DYEING METHODS TO PRODUCE DEEP DYEINGS WITH PHTHALOCYANINE DYES

The present invention relates to a method of dyeing on cellulose fiber material with phthalocyanine reactive dyes, in particular to a deep dyeing method on cellulose fibers with phthalocyanine reactive dyes at high temperature, in an aqueous liquor.

Phthalocyanine reactive dyes are blue/green dyestuffs optionally mixed with a fibre-reactive non-phthalocyanine and usually are metallised with metals such as $Cu^{++}$, $Ni^{++}$ and $Co^{++}$.

Phthalocyanine reactive dyes are not so widespread in the market, they are almost indispensable if it is desired to obtain a brilliant blue or green shade.

However, phthalocyanine reactive dyes have some disadvantages in dyeing processes for example:

1. The reaction speed of phthalocyanine reactive dyes is much slower than that of other reactive dyes (even those low reacting reactive dyes). As a result, they have a poor combinability with other dyes and so it is very hard to achieve good optimum dyeing conditions.
2. Because of the poor rate of take-up, the degree of take-up of phthalocyanine reactive dyes fluctuates significantly with slight differences in dyeing conditions.
3. The substantivity of phthalocyanine reactive dyes is so low that their build-up property becomes adversely affected (e.g. it is difficult to get very deep dyeings).
4. Phthalocyanine reactive dyes tend to cause unlevel dyeing due to physical factors, their bad combinability and dichroism dyeing (that is to say the tendency of the dye to be taken up and dispersed on the surface of the dyeings, resulting in a "flashing appearance").

According to the invention there is provided a method for deep dyeing of cellulose fibres, comprising dyeing the fibres with at least one phthalocyanine reactive dyes in a liquor (preferably an aqueous liquor such as a dye bath), containing more than 80 g/l of salt at pH of 10 or more, and dyeing is carried out at a dyeing temperature of above 100° C.

Preferably the pH is greater than or equal to 10, more preferably 10–13.

Dyeing temperatures may preferably range from 105°–150° C., more preferably from 105°–140° C., most preferably 105°–135° C. and especially about 130° C.

Preferably in a process according to the invention, the goods to liquor ratio is 1:3 to 1:60.

The time for dyeing (including fixing) is usually from 15 to 90 minutes to produce a well fixed dyeing. Usually dyeing for 60 minutes will be sufficient.

Preferably a dyestuff concentration used for this invention is 2–20% on weight of fibre (owf).

Any salt (conventionally used in dyeing processes) may be used in a process according to the invention. Such salts include NaCl and Glauber salt ($Na_2SO_4$). Glauber salt is preferred. The concentration of salt in a dyebath is preferably about 100–160 g/l, more preferably about 140 g/l in order to maximise fixation.

Alkali for fixing may further be added to the liquor of the invention to stabilize and increase the fixing rate of phthalocyanine reactive dyes. Alkali also assists in maintaining good reproducibility of dyeing and prevents salting-out that can happen because of the high amount of salt used in this invention.

Preferred alkalis which can be used are selected from: NaOH, KOH, $Na_2CO_3$, $Na_2SiO_3$, $NaHCO_3$, $K_2CO_3$, $K_3PO_4$ or $Na_3PO_4$ (especially soda ash, caustic soda, caustic potash potassium phosphate and potassium carbonate) or mixtures thereof, for example NaOH or KOH containing mixtures of alkali.

The concentration of fixing alkali in a dye bath is preferably from 0.5–5 g/l, more preferably 1.5–5 g/l, most preferably about 3 g/l.

Preferably the phthalocyanine reactive dyes used in this invention are metallised phthalocyanine chelate complex dyestuffs, more preferably in which the metal selected from Cu, Ni, Co, Al or Mg.

Most preferred phthalocyanine dyes used in the present invention are as follows:

| | |
|---|---|
| C.I. Reactive Blue 21 | C.I. Reactive Blue 169 |
| C.I. Reactive Blue 38 | C.I. Reactive Blue 207 |
| C.I. Reactive Blue 41 | C.I. Reactive Blue 231 |
| C.I. Reactive Blue 71 | C.I. Reactive Green 21 |
| C.I. Reactive Blue 77 | C.I. Reactive Green 12 and |
| C.I. Reactive Blue 116 | C.I. Reactive Green 25. |
| C.I. Reactive Yellow 161 | C.I. Reactive Yellow 165 |

One further advantage of a process according to the invention is that it is possible to use phthalocyanine reactive dyes together with other kinds of dyes. For example, phthalocyanine reactive dyes are frequently combined with brilliant bluish yellow reactive dyes to produce brilliant green shades.

Still further according to the invention there is provided a process for deep dyeing of cellulose fiber material comprising dyeing the fibers with a phthalocyanine reactive dye and non-phthalocyanine reactive dye in a liquor (preferably an aqueous liquor such as a dyebath) at pH of 10 or more containing more than 80 g/l salt characterized in that dyeing is carried out at a dyeing temperature above 100° C.

The new high temperature dyeing process according to the invention enables the achievement of deeper dyeings using the same amount of dyestuff (than by prior art dyeing processes). Dyeings by at least 20%, often over 30% deeper are achieved according to the process of the invention than those produced with conventional dyeing methods Other additives or auxiliaries can be added.

It is preferable to add a dyestuff protecting agent to counter the reduction of the colour yield. Such an agent is preferably an oxidation agent such as sodium nitrobenzene sulphonate, preferably in an amount of approximately 2 g/l. This will alleviate the hydrolysis of the dyestuffs.

Another additive which can advantageously be added is an agent to remove unfixed reactive dyestuff from the substrate. Such an agent is polyacrylic acid (neutralised at least in part with NaOH or KOH).

A process according to the invention can be used to dye natural and regenerated textile fibres, for example cellulose fibres such as cotton, rayon, linen and their blends with other fibres.

In the following Examples dyeings are described in which the goods to liquor ratio is 1:15, that is to say 15 parts of liquor are used per part of substrate dyed. All percentages are by weight of the substrate being dyed.

EXAMPLE 1

A cotton piece is introduced at pH 11.5 into a dyebath of an autoclave at 30° C., containing 1 g/l of sodium nitrobenzene sulphonate, 140 g/l of Glauber salt 12% of C.I. Reactive Blue 41 (commercially available as Drimarene Turquoise X-B CDG) and 3 g/l of a solution of 7.8 g KOH, 13.7 g $K_2CO_3$, 25.6 g $K_3PO_4$ and 4.8 gl of polyacrylic acid (molecular weight of about 500 thousand) neutralised with NaOH in 48.1 g of water.

This is allowed to stand for 15 minutes at this temperature after the autoclave is then closed. Over a period of 50 minutes, the temperature is brought to 130° C. and dyeing is carried out at this temperature for 60 minutes. The bath is then cooled to about 80° C. and the dyed substrate is removed, washed with water and soaped, washed again with water and dried.

Level blue dyeings having a depth of dyeing of over 35% compared to conventional dyeings using the same amount of dyestuff results.

EXAMPLE 2

Example 1 is repeated using

12% of C.I. Reactive Blue 41 (commercially available as Drimarene Turquoise X-B CDG)

4.8% of C.I. Reactive Yellow 161 (commercially available as Drimarene Brilliant Yellow X-6G) and 0.6% of C.I. Reactive Yellow 165 (commercially available as Drimarene Yellow X-RN) in place of 12% of C.I. Reactive Blue 41 of Example 1.

Level green dyeings having a depth of dyeing of over 35% compared to conventional dyeings using the same amount of dyestuff results.

EXAMPLES 3 TO 8

Example 1 is repeated using an appropriate amount of the following dyestuffs:

EXAMPLE 3

C.I. Reactive Blue 116

EXAMPLE 4

C.I. Reactive Blue 169

EXAMPLE 5

C.I. Reactive Blue 207

EXAMPLE 6

C.I. Reactive Green 12

EXAMPLE 7

C.I. Reactive Green 21 and

EXAMPLE 8

C.I. Reactive Green 25.

Good dyeings result.

What is claimed is:

1. A process for deep dyeing of cellulose fibers comprising the step of:

dyeing the fibers with at least one phthalocyanine reactive dye in a liquor containing more than 80 g/l of a salt wherein the liquor is at a pH of at least 11.5 and at a temperature of over 100° C.

2. The process according to claim 1 wherein the liquor is at a temperature of about 105° C. to 150° C.

3. The process according to claim 1 wherein the liquor is at a pH of up to 13.

4. The process according to claim 1 wherein the salt is NaCl or $Na_2SO_4$.

5. The process according to claim 1 wherein the concentration of salt in the liquor is about 100–160 g/l.

6. The process according to claim 1 wherein the liquor further comprises a fixing alkali.

7. The process according to claim 6 wherein the fixing alkali is selected from NaOH, KOH, $Na_2CO_3$, $Na_2SiO_3$, $NaHCO_3$, $K_2CO_3$, $K_3PO_4$, $Na_3PO_4$ and mixture thereof.

8. The process according to claim 6 wherein the concentration of the fixing alkali in the liquor is about 1.5–5.0 g/l.

9. The process according to claim 1 wherein the phthalocyanine dye is selected from the group consisting of:

| | |
|---|---|
| C.I. Reactive Blue 21, | C.I. Reactive Blue 169, |
| C.I. Reactive Blue 38, | C.I. Reactive Blue 207, |
| C.I. Reactive Blue 41, | C.I. Reactive Blue 231, |
| C.I. Reactive Blue 71, | C.I. Reactive Green 21, |
| C.I. Reactive Blue 77, | C.I. Reactive Green 12, |
| C.I. Reactive Blue 116 and | C.I. Reactive Green 25. |

10. A process according to claim 1 wherein the cellulose fibers are natural or regenerated cellulose fibers.

11. A process according to claim 1 wherein the cellulose fibers are natural or regenerated cellulose fibers blended with non-cellulose fibers.

12. A process according to claim 1 wherein the liquor further comprises a dyestuff protection agent effective against the reduction of the color yield of the dyestuff.

13. A process according to claim 1 wherein the liquor further comprises an agent effective to remove unfixed reactive dyestuff from the substrate.

* * * * *